US005101586A

United States Patent [19]

Zennedjian

[11] Patent Number: 5,101,586

[45] Date of Patent: Apr. 7, 1992

[54] PICTURE FRAME ASSEMBLY FOR UPRIGHT POSITIONING OF A PICTURE AND THE LIKE

[76] Inventor: Garbis Zennedjian, 2606 N. Woodward, Royal Oak, Mich. 48073

[21] Appl. No.: 535,968

[22] Filed: Jun. 11, 1990

[51] Int. Cl.[5] ..... G09F 1/12

[52] U.S. Cl. ..... 40/152.1; 40/159.1

[58] Field of Search ..... 40/152.1, 158.1, 159.1, 40/156, 152

[56] References Cited

U.S. PATENT DOCUMENTS

| | | | |
|---|---|---|---|
| 3,665,629 | 5/1972 | Shore | 40/156 |
| 4,356,648 | 11/1982 | Beaulieu | 40/156 X |
| 4,422,613 | 12/1983 | Cray et al. | 40/152.1 X |
| 4,776,117 | 10/1988 | Astolfi | 40/152.1 |

FOREIGN PATENT DOCUMENTS

WO88/02229 4/1988 World Int. Prop. O. ..... 40/152

*Primary Examiner*—Kenneth J. Dorner
*Assistant Examiner*—Joanne Bonifanti
*Attorney, Agent, or Firm*—Gifford, Groh, Sprinkle, Patmore and Anderson

[57] ABSTRACT

A picture frame assembly for substantially upright positioning of a picture and the like on a planar surface comprises a frame body and a brace. In its preferred embodiment the brace configuration represents a "Y" in cross section with the brace being composed of a resilient material. The "v" end of the "Y" is removably interfittable with a channel peripherally defined in the back side of the frame body, the brace being frictionally held by tension therein. A plurality of mask inserts are removably provided for selective placement over unsightly fasteners positioned within the channel.

2 Claims, 1 Drawing Sheet

PICTURE FRAME ASSEMBLY FOR UPRIGHT POSITIONING OF A PICTURE AND THE LIKE

BACKGROUND OF THE INVENTION

I. Field of the Invention

The present invention relates generally to picture frames for the mounting of pictures and the like therein. More particularly, the present invention relates to a picture frame assembly for upright mounting of a picture frame when the picture frame assembly is situated on a planar surface. The picture frame assembly includes a frame body having a channel peripherally defined about its back side wherein a brace is removably fitted within the channel. The assembly optionally includes a mask insert also for positioning on the back side of the frame assembly.

II. Description of the Relevant Art

Framing structures are well known for displaying paintings, pictures, photographs, diplomas, licenses, or the like. Such structures generally consist of a metallic, wooden or plastic molding surrounding a window opening sometimes provided with a pane of glass or transparent plastic.

Most of the known framing structures are directed at mounting of the article and the frame on the wall of an office, den, living room and the like. However, when provisions are made for mounting such frames on a table, such structures have generally included a flap being hingedly mounted on the back side of the frame structure.

These flap assemblies of known constructions have only a limited utility, because over time the hinged portion is too often flexed and, as a result, very often shears or simply breaks off. Once the hinged flap is broken away or worn, the frame structure is no longer positionable in a substantially upight position on the planar surface.

In addition, the known assemblies for maintaining a framing structure in an upright position suffer from well understood defects of being both aesthetically displeasing and impractical. The assembly is aesthetically displeasing, because, when viewed from the back side, a gap is generally left where the flap has been withdrawn from the backing portion to which it is hinged.

The flap is also impractical because, in addition to the fact that it is prone to wear as noted above, the flap may itself collapse back to the base portion to which it is hingedly attached, or may, alternatively, not be able to deliver the full support required for the upright positioning of heavier objects.

Furthermore, known frame structures, when viewed from the back side, are also aesthetically displeasing in that, when metal frame elements are utilized, the fastening means used to interattach one element to the other are visible from the back side. This results in a frame which, while being pleasing from the front side, is not pleasing from the back side. This, of course, is of particular concern to persons who have office desks upon which are placed picture frames. The picture frames are viewable from the back side when a client or a similar individual enters the room, thus perhaps compromising the overall appearance of the office.

Accordingly, the prior approaches to providing framing structures for pictures and the like which may be placed upon a planar surface such as a desk and the like have failed to provide a brace which is both efficient and pleasing, and have further failed to provide a method by which the back side of the picture frame itself may be made more aesthetically pleasing.

SUMMARY OF THE PRESENT INVENTION

The present invention provides a picture frame assembly for substantially upright positioning of a picture and the like on a planar surface such as a desk, a table or a similar surface.

The frame body of the present invention comprises a front side and a back side. Preferably, the frame body of the present invention is composed of a metallic material, although an extrudable polymerizable material may be employed. In the back side of the frame there is provided a peripheral channel. The frame according to the present invention provides a parallelogram composed of four frame members. Each frame member is joined to an adjacent frame member by a fastening means. The fastening means is situated within the channel, thereby leaving no element of the fastening means to be disposed above the top side plane of the channel.

The present invention includes a brace element for achieving the desired upright position of the picture frame, and mask inserts for selectively situating upon the back side to thereby cover up the unsightly fasteners used to interconnect the frame members.

In its preferred embodiment, the brace itself is preferably composed of a resilient polymerized material. The brace defines a "Y" in cross section. The "v" end of the brace comprises two arms which are squeezed toward one another on insertion and thereafter removably placed within the channel of the back side of the frame. The brace is thereafter held within the channel by frictionally tension created by the resilient nature of the "v" section of the brace.

The remaining end of the "Y" configuration, or the tail end, itself provides the brace. This portion of the brace rests upon the planar surface upon which the frame assembly is positioned.

In this construction, one or more of the braces may be fitted within the back side of the frame assembly. Preferably, the braces are situated at the bottom frame member (or lower frame member). By this construction, the brace provides the least amount of interference with the desk top activity and takes up the least amount of space. Furthermore, the brace according to the present invention, unlike the known braces, will not wear out due to repeated movement of a hinge.

If the brace of the present invention was to wear out, it may simply be replaced, thereby eliminating the necessity of having to remove the cardboard backing commonly used in today's frame structures which embodies the hinged flap to provide the brace of known frame structures.

To further minimize the aesthetic unattractiveness of known frames, the brace of the present invention only minimally interfits with the frame member, thereby leaving no exposed surfaces from the base cardboard which supports the picture and the like situated within the frame assembly.

To further minimize any aesthetic unpleasantness, a plurality of mask inserts are provided for selectively positioning upon the back side of the frame assembly. The mask inserts are preferably situated at each of the four corners of the frame, and include a chevron-shaped body, the body having tabs positioned at each of its ends. The tabs are, as is the entire body, composed of a resilient material, and the tabs themselves are situated in a downward depending manner from the plane of the mask insert. Thus provided, the tabs are interfitted within the channel defined on the back side of the frame. This interfittable relationship is characterized by the close tolerance created between the edges of the tab and the inner edges of the channels. Thus, the mask inserts may be removably interfitted on the back side of the frame to provide a very neat and uncluttered appearance to the back side of the frame.

In an alternate embodiment of the present invention, the brace assembly itself may be formed as one with one or more of the mask inserts. According to this embodiment, the brace and at least two mask inserts are interfittable with the back side of the frame assembly as one unit, to thereby provide many of the advantages discussed above, including strength and aesthetic appeal.

The elements of the present invention may be inexpensively made from, as noted, a polymerized material. Furthermore, the elements, being composed of such a polymerized material, are of course of a light weight, thereby minimizing any weight added to the overall frame assembly.

When the elements of the present invention are in place on the frame assembly, one may view the back side of the frame assembly and be pleased at the appearance thereof.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
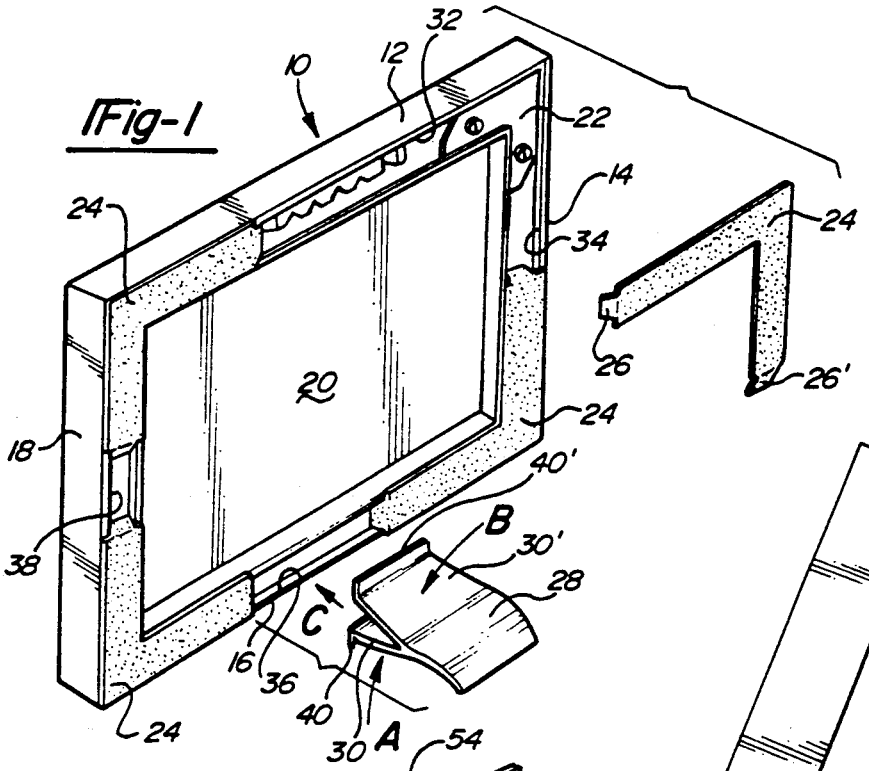
FIG. 1 is a perspective view illustrating the brace member of the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a frame construction is shown, generally indicated as 10. As viewed in this illustration, the frame construction 10 is seen from its back side. According to the preferred embodiment, the frame construction 10 includes four frame members 12, 14, 16, 18 and has a picture mount 20 disposed centrally between the members 12, 14, 16, 18. Viewed from this perspective, the mount 20 discloses its back side. On its front side (not visible), the mount 20 supports a photograph, a certificate, diploma and the like.

Each of the frame members 12, 14, 16, 18 is U-shaped in cross section. Each of the members 12, 14, 16, 18 has axially defined therein a channel 32, 34, 36, 38, respectively. The members 12, 14, 16, 18 are interconnected by a plurality of fasteners 22 of which only one is visible. The fasteners 22 interconnect each adjacent ones of the members 12, 14, 16, 18. The fasteners 22 substantially fit within the channels 32, 34, 36, 38 of the members 12, 14, 16, 18, whereby the fasteners 22 are disposed within the channels themselves.

To cover the unsightly appearance created by the presence of the fasteners 22, the present invention discloses a plurality of mask elements 24 which are directed at fitting over and hence covering up the fasteners 22. Each mask element 24 includes a pair of flanges 26, 26' which are fittable within the channels 32, 34, 36, 38 of the members 12, 14, 16, 18 and are provided with such tolerance so as to be frictionally engaged with the channels of the members 12, 14, 16, 18. The flanges 26, 26' are, as illustrated in FIG. 1, downwardly inclined so as to be lockably engageable with the channels 32, 34, 36, 38.

Preferably, the mask elements 24 are composed of a polymerized material which is both light weight and resilient.

In addition to disclosing the mask elements 24 of the present invention, FIG. 1 also discloses a stand member 28 that is preferably interfittable within the channel 36 of the member 16, or that member provided on the bottom side of the frame construction 10. Like the mask elements 24, the stand member 28 is preferably composed of light weight and resilient polymerizable material.

The stand member 28 is preferably Y-shaped in cross section. The "v" portion of the "Y" comprises a pair of tabs 30, 30' respectively having lips 40, 40' positioned at the ends thereof.

To engage the stand member 28 with the channel 36 of the member 16, the tabs 30, 30' are pressed toward one another in the respective directions indicated by arrows "A" and "B". Thereafter, the stand member 28 is inserted into the channel 36 according to the direction of arrow "C".

Figure 2:
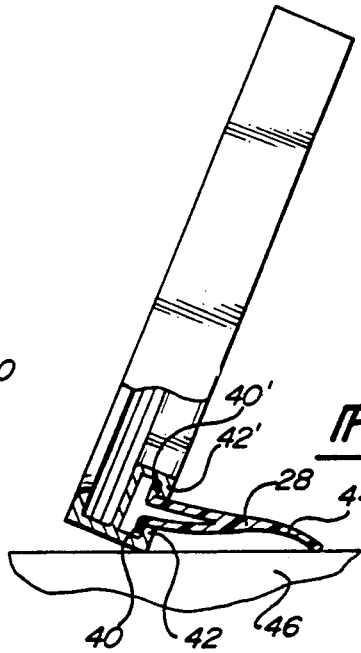
FIG. 2 is a side elevational view partially in section illustrating a preferred embodiment of the mask insert of the present invention with the stand member in place supporting this frame on a flat surface.

When the pressure applied to the tabs 30, 30' is released, the stand member 28 is locked within the channel as illustrated in FIG. 2.

With reference thereto, FIG. 2 illustrates in cross section the stand member 28 in place within the channel 36. The channel 36 includes a pair of spaced apart ledges 42, 42' against which the lips 40, 40' respectively engage. Thus positioned, the stand member 28 is frictionally held within the channel 36. As illustrated, the member 28 defines a downwardly depending end portion 44 which rests upon a planar surface 46 and provides support to the frame construction 10 so that it may be positioned upright upon the surface 46.

Figure 3:
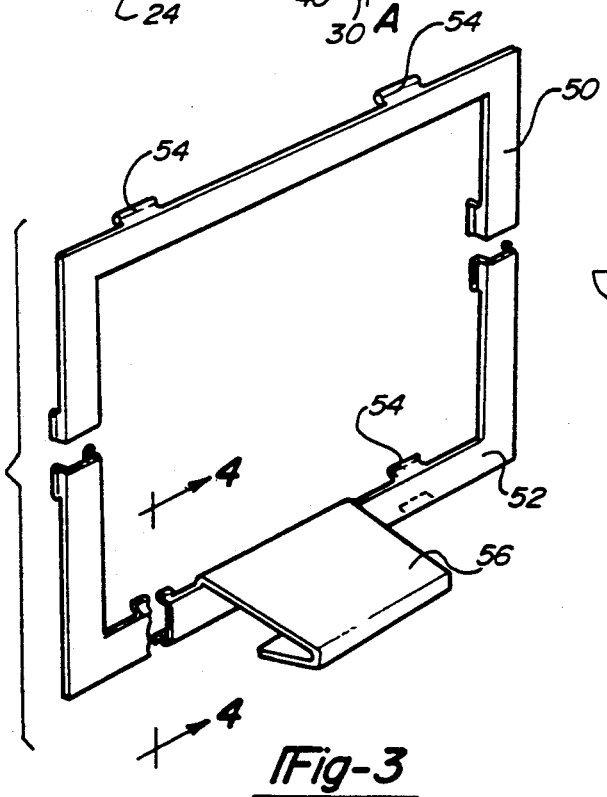
FIG. 3 is a perspective view illustrating the back side of the preferred embodiment of the present invention with the brace and the mask inserts in place.

Referring to FIG. 3, an alternate embodiment of the present invention is disclosed and includes an upper mask portion 50 and a lower mask and support portion 52. Each of the portions 50, 52 includes a plurality of channel-interlocking flanges 54 which are positioned at inner and outer edges 51 and 53 of the portions 50 and 52 and which lockingly engage the channels 32, 34, 36,

38 of a frame construction 10 substantially as described above with respect to the embodiment of FIGS. 1 and 2.

Figure 4:
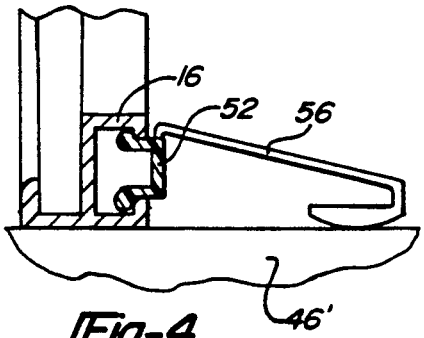
FIG. 4 is a side elevational view partially in section, similar to FIG. 2 presenting an alternate embodiment of the present invention illustrating a unitized mask insert and brace assembly fitted on the back side of a frame assembly.

The lower mask and support portion 52 includes a stand portion 56 integrally defined therewith. When, as illustrated in FIG. 4, the lower mask and support portion 52 is engaged in the respective channels, the stand portion 56 is outwardly directed to provide support for the frame construction 10 upon a planar surface 46'.

Having described my invention, however, many modifications thereto will become apparent to those skilled in the art to which it pertains without deviation from the spirit of the invention as defined by the scope of the appended claims.

I claim:

1. A picture frame assembly for substantially upright positioning of a picture on a planar surface, said frame assembly comprising:

a frame body having a back side and a front side, said back side having a peripherally disposed channel defined therein;

a stand portion for supporting said frame body, said stand portion being interfittable with said back side of said frame body; and an upper mask portion and a lower mask and support portion, said upper and lower mask portions selectively masking said back side of said frame body, said upper and lower mask portions being interfittable with said back side of said frame body, said upper mask portion and said lower mask and support portion further having pluralities of channel interlocking flanges along inner and outer edges thereof for securing said mask portions within said channel, said lower mask and support portion and said stand portion being integrally formed in a one-piece construction.

2. The picture frame assembly of claim 1 wherein said brace defines a "Y" in cross section, a portion of said brace being removably interfittable with said channel.

* * * * *